US005570833A

United States Patent [19]

Dusek

[11] Patent Number: 5,570,833

[45] Date of Patent: Nov. 5, 1996

[54] AUTO-LOCKING HANGING FILE FOLDER

[76] Inventor: Zipper Dusek, 540 W. Roscoe St., Chicago, Ill. 60657

[21] Appl. No.: 172,058

[22] Filed: Dec. 23, 1993

[51] Int. Cl.[6] ..... B65D 27/00

[52] U.S. Cl. ..... 229/67.2; 40/359; 312/183

[58] Field of Search ..... 383/13, 37; 229/68 C, 229/69, 1.5 R, 67.1, 67.2, 67.4; 206/526; 40/359; 312/183

[56] References Cited

U.S. PATENT DOCUMENTS

| | | | |
|---|---|---|---|
| 2,052,623 | 9/1936 | Harby . | |
| 2,138,788 | 11/1938 | Hart et al. . | |
| 3,748,971 | 7/1973 | Grundell . | |
| 4,031,646 | 6/1977 | de Nouel | 40/359 |
| 4,294,028 | 10/1981 | Remond | 40/359 |
| 4,642,934 | 2/1987 | Carlson et al. | 383/11 X |
| 4,811,768 | 3/1989 | Williams | 383/13 X |
| 4,830,268 | 5/1989 | Pitts . | |
| 4,907,633 | 3/1990 | Eckstein | 383/13 X |
| 5,141,485 | 8/1992 | Welt . | |

FOREIGN PATENT DOCUMENTS

| | | | |
|---|---|---|---|
| 1560060 | 2/1969 | France | 40/359 |
| 252010 | 2/1964 | Netherlands | 40/359 |
| 390873 | 8/1965 | Switzerland | 40/359 |

*Primary Examiner*—Jes F. Pascua
*Attorney, Agent, or Firm*—Patula & Associates

[57] ABSTRACT

An improvement for conventional hanging file folders is comprised of connection means for releasably locking juxtaposed file folders with the connection means comprised of "Velcro"-type fasteners releasably connecting the hanging file folders having conventional front and back or first and second covers. The hook units is affixed to each of the upper exterior corners of each file folder on one file folder cover, and the loop unit is affixed to each of the upper exterior corners of each file folder on its second cover. When the second cover of a hanging file folder is brought into storage position adjacent to the first cover of a second hanging file folder, the fastener pairs releasably lock to prevent the juxtaposed folders from separating. A strap formed of flexible, durable material having a first end and a second end, with said first end having a loop unit affixed thereto and said second end having a hook unit affixed thereto can be connected to an individual file folder removed from its stationary position for transport to another location by cooperatively associating said loop unit of said first end with one of the hook units of said file folder, and by cooperatively associating said hook unit of said second end of said strap with the loop unit of the opposite corner of said file folder.

10 Claims, 1 Drawing Sheet

FIG.1
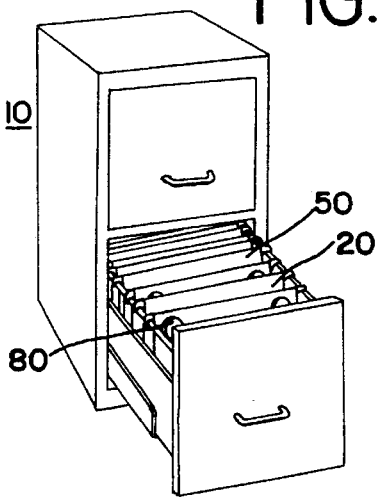
FIG.2
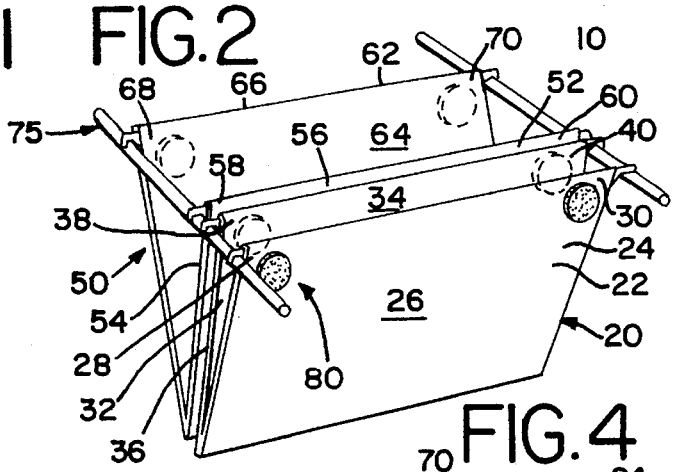
FIG.3
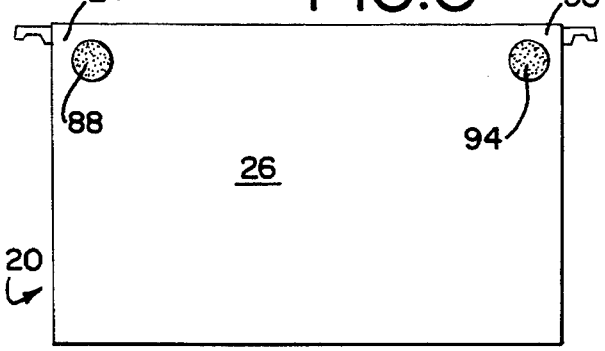
FIG.4
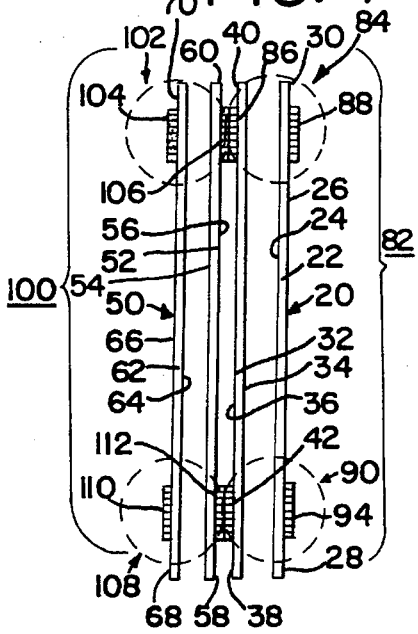
FIG.5
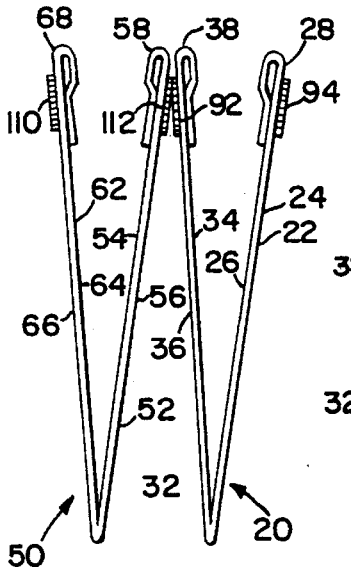
FIG. 6
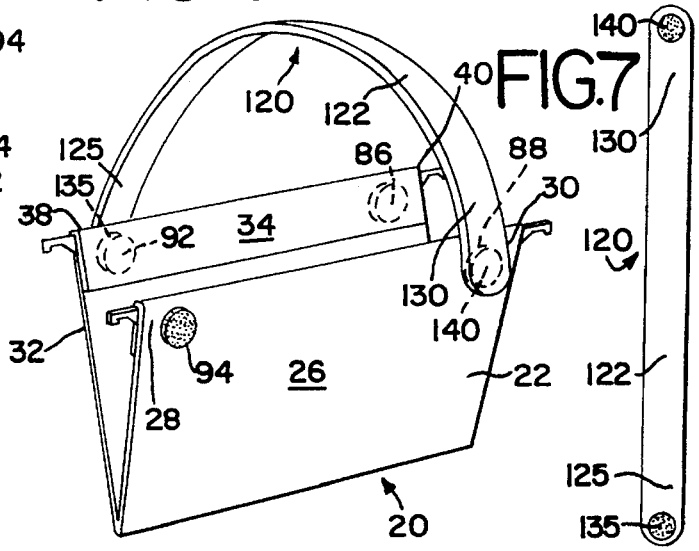
FIG.7

AUTO-LOCKING HANGING FILE FOLDER

This invention related to hanging file folder systems and, in particular, as an improvement in conventional hanging file folder systems by providing a disengagable automatic locking means for connecting juxtaposed hanging file folders.

BACKGROUND OF THE INVENTION

Hard copy records management and office organization are one of the most critical areas of running a great number of businesses and other activities smoothly and efficiently. Numerous devices exist to help keep files ordered and hard copy records readily retrievable. For example, in the area of filing cabinets, hanging or suspension file folders have presented a significant improvement to keeping files ordered and still accessible by allowing for easy deposit, removal and rearrangement of files and file folders, in contrast with files deposited directly in a file drawer, shelf or other storage location and either stacked with other files or otherwise compacted to make retrieval and further filing very cumbersome.

Other inventions have introduced improvements to hanging file folders. For example, in PCT Application No. PCT/SE89/00445 published Mar. 22, 1990, an arrangement of forming an index flap in suspension file folders is disclosed to enhance the organization function of hanging file folders by allowing for tabbing removable capacity. In U.S. Pat. No. 3,748,971, a method is taught for connecting the rigid member used to suspend a hanging file folder and the folder itself.

Folders themselves also have received significant market and manufacturing attention given their importance in keeping documents organized. In U.S. Pat. No. 2,052,623, for example, a folder having a reinforced margin is disclosed to improve filing and tabbing capacity of file folders. In U.S. Pat. No. 4,830,268, an adjustable file folder is taught having an overlap pocket which releasably connects to the main body of the file folder to accommodate variable file volumes. By unconnecting the overlap fold, the larger pocket volume is accessed to increase the total file volume available. Additionally, in U.S. Pat. Nos. 5,141,485 and 1,238,788, various methods are disclosed of making a file folder.

A significant problem which remains with hanging file folders despite the various improvements in the art, however, is that the folders tend to separate one from another when being rearranged within a file drawer. Frequently, documents are misfiled by placing them between file folders instead of within a proper file folder. This results in the document slipping underneath the suspended files and becoming misplaced, frequently unaccounted for for long periods of time or until the hanging file folders are removed altogether from the file drawer or other storage space where they are kept.

One subject of the present invention is to provide an improvement in conventional hanging file folders for preventing individual folders from separating and leaving open storage spaces into which loose documents can be misfiled or lost.

Another object of the present invention is to provide an automatic connection means for releasably locking hanging file folders together to save time, resources and filing effort by ensuring that file rearrangement will pen only file folder spaces, not open file drawer space.

Another object of the present invention is to provide an improvement comprised of versatile means for connecting conventional hanging file folders when stored next to one another in conventional fixed storage units, which means is inexpensive to employ either for specially manufactured hanging file folders or for existing folders to be adapted with said improvement while at the same time being uncomplicated to operate.

Still another object of the present invention is to provide an improvement in conventional hanging file folders which allows for releasable locking connection of juxtaposed file folders with one arrangement, or non-locking juxtaposition of file folders with a minor, no-cost and ready variation of the same folders.

Yet another object of the present invention is to provide an improvement for storing conventional hanging file folders within fixed storage units such as cabinets drawers by eliminating open storage space between adjacent file folders through releasable folder connection means, while also providing carrying means for transporting individual file folders outside of said storage units using the same connection means and a carrying strap adaption.

It is a further object of the invention to provide a method of selectively preventing documents from being filed or misplaced between adjacent file folders in a file folder system.

SUMMARY OF THE INVENTION

The present invention addresses the problem for files being misplaced between adjacent hanging file folders by providing disengagable automatic locking means for connecting juxtaposed hanging file folders. In the preferred embodiment of the invention, this means is comprised of hook and loop-type fasteners, conventionally referred to by the trade name "VELCRO" releasably connecting the hanging file folders having the convention front and back or first and second covers. The hook unit is affixed to each of the upper exterior corners of each file folder on one file folder cover, and the loop unit is affixed to each of the upper exterior corners of each file folder on its second cover. When the second cover of a hanging file folder is brought into storage position adjacent to the first cover of a second hanging file folder, the fastener paris releasably lock to prevent the juxtaposed folders from separating.

In an alternate embodiment of the present invention, the auto-locking hanging file folder is further enhanced by a strap formed of flexible, durable material having a first end and a second end, with said first end having a loop unit affixed thereto and said second end having a hook unit affixed thereto. When a hanging file folder is removed from its stationary position for transport to another location, said strap can be utilized to assist in file carrying by cooperatively associating said loop unit of said first end with one of the hood units of said file folder, and by cooperatively associating said hook unit of said second end of said strap with the loop unit of the opposite corner of said file folder to provide the likes of a releasable shoulder or carrying strap.

BRIEF DESCRIPTION OF THE INVENTION

FIG. 1 is a perspective view of the front of a filing cabinet with one file drawer open to reveal hanging file folders and the auto-locking hanging file folder improvement of the present invention;

FIG. 2 is a perspective view of two juxtaposed hanging file folders locked together by the present invention;

FIG. 3 is a front elevational view of the exterior of one cover of a hanging file folder showing one set of connection means of the present invention affixed to the upper corners of the file cover;

FIG. 4 is a top plan view of the present invention showing two juxtaposed hanging file folders locked together by the present invention;

FIG. 5 is a side elevational view of the present invention showing two juxtaposed hanging file folders locked together by the present invention;

FIG. 6 is a perspective view of an alternate embodiment of the present invention as comprising a carrying strap releasably engaging the connection means of the present invention; and FIG. 7 is a top plan view of the carrying strap disengaged from the hanging file folder depicted in FIG. 6.

DETAILED DESCRIPTION OF THE PREFERRED EMBODIMENT OF THE PRESENT INVENTION

The objects of the present invention, its advantages and other aspects will be apparent upon consideration of the following detailed description of the invention. This detailed description is intended to disclose the invention by way of example through preferred embodiments, and is not intended to limit the spirit and scope of the invention.

Referring now to FIG. 1, the present invention is a hanging file folder system 10 comprised of at least two hanging file folders held within a conventional storage unit such as a filing cabinet drawer, shown here and throughout the drawings as first folder 20 and second folder 50. As shown more particularly in FIGS. 2, 4 and 5, the present invention is comprised of said first folder 20 having a first cover 22 with an interior face 24, and exterior face 26, upper exterior corners 28 and 30, and second cover 32 having an interior face 34, exterior face 36, and upper corners 38 and 40. The present invention is further comprised of said second folder having a first cover 52 with an interior face 54, and exterior face 56, upper exterior corners 58 and 60, and second cover 62 having an interior face 64, exterior face 66, and upper corners 68 and 70. Hanging means 75 extend from said upper corners of said file folders 20 and 50 and are conventional hanging file folder means for suspending file folders 20 and 50 from a rigid storage support such as a file cabinet drawer like the one shown in FIG. 1

The present invention is further comprised of connection means 80, shown in FIGS. 2, 4 and 5, having a pair 82 of hook and loop type fasteners affixed to said first file folder 20 and a pair 100 of hook and loop type fasteners affixed to said second file folder 50. Said pair 82 is comprised of a first set of fasteners 84 having a loop unit 86 and hook unit 88, and a second set of fasteners 90 having a loop unit 92 and a hook unit 94. Said hook units 88 and 94 are affixed to said upper exterior corners 30 and 28, respectively, of said exterior face 26 of first cover 22 of said first folder 20. Said loop units 86 and 92 are affixed to said upper exterior corners 40 and 38, respectively, of said exterior face 36 of said second cover 32 of said first folder 20. Similarly, said file folder 50 has affixed to its upper exterior corners 58, 60, 68 and 70, hook and loop type fasteners of pair 100, comprised of a first set 102 having loop unit 104 and hook unit 106, and second set 108 having loop unit 110 and hook unit 112. Said hook units 106 and 112 are affixed to said upper exterior corners 60 and 58, respectively, of said exterior face 56 of said first cover 52 of second folder 50. Said loop units 104 and 110 are affixed to said upper exterior corners 70 and 68, respectively, of said exterior face 66 of said second cover 62 of file folder 50. The hook units of each set of fasteners 84, 90, 102 and 108 cooperatively associate with a loop unit of an adjacent file folder to automatically and releasably connect the juxtaposed file folders in locking fashion. FIGS. 2, 4 and 5 show the connection means 80 of the present invention with said loop unit 86 of said file folder 20 engaging said hook unit 106 of said file folder 50, and said loop unit 92 of said file folder 20 engaging said hook unit 112 of said file folder 50. Hook units 88 and 94 of said file folder 20 remain unpaired, as shown in FIGS. 2, 3, 4 and 5 for connection with additional file folders. Similarly, loop units 104 and 110 of said file folder 50 remain unpaired until juxtaposed with the hook units of another adjacent hanging file folder having the connection means 80 affixed to its upper exterior corners.

In the event a user of the present invention desires a separation between adjacent files, said file folder 50 for example, would be reversed in placement next to said file folder 20 such that said second cover 62 of said file folder 50 juxtaposed said second cover 32 of said file folder 20, whereby loop units 104 and 110 of file folder 50 juxtapose loop units 86 and 92 of file folder 20 without locking said file folder 50 against said file folder 20.

In an alternate embodiment of the present invention, as shown in FIGS. 6 and 7, said hanging file folder system 10 is further defined by removable carrying means 120 comprised of a flexible, durable strap 122 having a first end 125 and a second end 130, with a hook unit 135 affixed to said first end 125 and a loop unit 140 affixed to said second end 130, said hook unit 135 and loop unit 140 being of the same hook and loop type fastener units affixed to said file folders 20 and 50. Said hook unit 135 releasably lock engages said loop unit 92 of file folder 20, for example, and said loop unit 140 releasably lock engages said hook unit 88 of said file folder 20 to provide a lightweight, easily implement carrying strap for transporting said file folder 20 from place to place outside of its stationary storage location.

It is foreseen that the hook units and the loop units of the present invention could be interchanged or reversed in placement on the folders, so long as they cooperatively attach to connect adjacent folders together when desired. It is further foreseen that the fastening means of the present invention is not limited to the use of hook and loop type fasteners, but could be clips, snaps, adhesives or any other suitable fasteners.

It is to be understood that the embodiments herein described are merely illustrative of the principles of the present invention. Various modifications may be made by those skilled in the art without departing from the spirit and scope of the claims which follow.

I claim:

1. An improvement in hanging file folders, said improvement comprising:

connection means affixed to file folder upper exterior corners for releasably lock-engaging said folder to a second file folder against which said first folder is juxtaposed within a stationary storage unit; and carrying means for converting said file folder from a stationary storage unit to a transportable storage unit utilizing said connection means in cooperative association with said carrying means;

said connection means is comprised of hook and loop type fasteners affixed to the upper exterior corners of said file folder such that said file folder releasably locks against a second file folder by cooperatively associating said hook and loop type fasteners upon juxtaposition contact of said file folders, and said carrying means is comprised of a strap having a first end and a second end, said first end adapted with said hook and loop type fasteners to cooperatively engage an up per exterior corner of said file folder at one cover, and said second end adapted with said hook and loop type fasteners to cooperatively engage an opposite exterior corner of a second cover of said file folder.

2. The improvement recited in claim 1, wherein said file folder has a first cover and a second cover, and said connection means is comprised of two first units, one each affixed to the upper exterior corner of said first cover and two second units, one each affixed to the upper exterior corner of said second cover, with said strap being further defined by said first end of said strap having a first unit affixed thereto and said second end of said strap having second unit affixed thereto, whereby said strap is releasably connected to said file folder by cooperatively associating said first unit of said first end to said second unit of said second cover, and said second unit of said second end of said strap releasably connected to said first unit of said first cover of said folder.

3. A file folder system for use in a storage unit comprising:

a plurality of file folders, each of said file folders having a front cover with an interior face and an exterior face with upper exterior corners, and a back cover with an interior face and an exterior face with upper exterior corners, said file folders proximately positioned next to each other with said exterior faces of said back covers juxtaposed with said exterior faces of said front covers and defining an openable area in between said front covers of one file folder, and said back cover of adjacent file folders;

fastening means fixedly attached to said upper exterior corners of said front covers;

complimentary fastening means fixedly attached to said upper exterior corners of said back covers, said complimentary fastening means of one file folder selectively and removably cooperating with said fastening means of an adjacent file folder to selectively close said openable areal;

said plurality of file folders being hanging file folders which hang on hanging means in a storage unit;

said file folders being removable from said storage unit, said file folder system further comprising means for carrying said file folders upon removal from said storage unit;

said means for carrying comprising a flexible strap having a first end and second end, said first end having fastening material attached thereto and said second end having complimentary fastening material attached thereto, said fastening material on said first end selectively cooperating with said complimentary fastening material on an upper exterior corner of said back cover of a file folder, and said complimentary fastening material on said second end selectively cooperating with said fastening material on an opposite upper exterior corner of said front cover.

4. A locking file folder system for a file storage unit, comprising:

a plurality of file folders each comprising a first cover having upper exterior corners and a second cover having upper exterior corners, said file folders being stored adjacent one another with said first cover of one folder positioned proximate said second cover of an adjacent file folder, and defining a space therebetween;

hook type fasteners attached to one of said first cover and said second cover and positioned at said upper exterior corners; and loop type fasteners attached to the other of said first cover and said second cover and positioned at said upper exterior corners;

said hook type fasteners cooperating with said loop type fasteners at the upper exterior corners of said first cover of said one folder and said second cover of said adjacent folder to releasably connect said one folder to said adjacent folder at two separate and distinct locations to prevent unintentional placement of folder items in said space therebetween; and means for selectively transporting at least one of said plurality of file folders, said means including a strap having ends, and hook and loop type fasteners disposed at said ends, said hook and loop type fasteners cooperating with said hook type fasteners and said loop type fasteners of said at least one of said plurality of folders, securing said strap thereto.

5. The file folder system claim 4, wherein said hook type fasteners and said loop type fasteners allowing said one file folder to be attached to said adjacent file folder when said one file folder is misaligned with said adjacent file folder by said hook type fastener and said loop type fastener each defining an areal dimension, said hook type fasteners cooperating with said loop type fasteners upon contact of a portion of said areal dimension of said hook type fastener with a portion of said areal dimension of said loop type fastener.

6. The file folder system of claim 4, wherein said one file folder and said adjacent file folder self-lock within said file storage unit upon placement of said one file folder proximate said adjacent file folder and upon contact of said first cover of said one file folder with said second cover of said adjacent file folder.

7. A self-locking hanging file folder system for use in a file storage unit, comprising:

a plurality of file folders each comprising a first cover having two upper corners and a second cover having two upper corners, said file folders being stored adjacent one another with said first cover of said first adjacent folder positioned proximate said second cover of said second adjacent folder, and defining a space therebetween;

means for fastening attached to said first cover of said first adjacent folder at each upper corner; and complimentary means for fastening attached to said second cover of said second adjacent folder at each upper corner;

said means for fastening and said complimentary means for fastening cooperating to releasably connect said two upper corners of said first adjacent folder to said two upper corners of said second adjacent folder to prevent unintentional placement of folder items in said space therebetween;

said first adjacent folder and said second adjacent folder self-locking within said file storage unit upon placement of said first adjacent folder proximate said second adjacent folder and upon contact of said first cover of said first adjacent folder with said second cover of said second adjacent folder; and means for selectively transporting at least one of said plurality of file folders, said means including a strap having ends, and fasteners disposed at said ends, said fasteners cooperating with said means for fastening and said complimentary means for fastening of said at least one of said plurality of folders, securing said strap thereto.

8. A method of selectively preventing the misfiling of documents in an area between adjacent file folders in a storage area comprising a drawer of a filing cabinet, said method comprising the steps of:

attaching fastening means to upper exterior corners on a front cover of one file folder;

attaching complimentary fastening means to upper exterior corners of a back cover of an adjacent file folder; and selectively connecting said fastening means to said complimentary fastening mean to enclose said area between adjacent file folders by:

placing said one file folder proximate to said adjacent file folder; and imparting movement to at least one of said one file folder and said adjacent file folder by closing said drawer such that said fastening means contacts said complimentary fastening means;

said fastening means and said complimentary fastening means are hoop and loop type fasteners.

9. The method of claim 8, wherein said file folders are hanging file folders.

10. The method of claim 8, further comprising the steps of:

selectively attaching means for carrying to said complimentary fastening means; and transporting said file folders via said means for carrying.

* * * * *

UNITED STATES PATENT AND TRADEMARK OFFICE

CERTIFICATE OF CORRECTION

PATENT NO. : 5,570,833

DATED : November 5, 1996

INVENTOR(S) : ZIPPER DUSEK

It is certified that error appears in the above-identified patent and that said Letters Patent is hereby corrected as shown below:

The terms "up per" in Claim 1 on line 6 of Column 5 should read --upper--.

Signed and Sealed this

First Day of April, 1997

*Attest:*

*Attesting Officer*

BRUCE LEHMAN

*Commissioner of Patents and Trademarks*